United States Patent [19]

Katsura et al.

[11] 4,366,662

[45] Jan. 4, 1983

[54] PROCESS FOR PREPARATION OF CANS AND CANNED PROVISIONS

[75] Inventors: Tadahiko Katsura, Yokohama; Kazuhisa Ishibashi; Kazumi Hirota, both of Tokyo, all of Japan

[73] Assignee: Toyo Seikan Kaisha, Ltd., Tokyo, Japan

[21] Appl. No.: 162,892

[22] Filed: Jun. 25, 1980

[30] Foreign Application Priority Data

| | | | |
|---|---|---|---|
| Jun. 30, 1979 | [JP] | Japan | 54-82016 |
| Aug. 17, 1979 | [JP] | Japan | 54-104050 |
| Aug. 17, 1979 | [JP] | Japan | 54-104051 |

[51] Int. Cl.[3] ..... B21D 51/26

[52] U.S. Cl. ..... 53/478; 156/69; 413/7

[58] Field of Search ..... 53/471, 478, 486, 485, 53/329; 156/69; 220/67; 113/1 E, 120 R, 120 A, 120 V, 120 XY, 120 Y, 120 K, 121 AB, 121 C, 121 R; 413/2, 4, 7, 43

[56] References Cited

U.S. PATENT DOCUMENTS

| | | | |
|---|---|---|---|
| 1,231,585 | 7/1917 | Fleischer | 53/471 X |
| 3,815,314 | 6/1974 | Pollock et al. | 53/471 X |
| 3,909,326 | 9/1975 | Renck | 53/478 X |
| 3,952,677 | 4/1976 | Hartman et al. | 113/120 R |
| 4,237,360 | 12/1980 | Pohlenz | 156/69 X |

*Primary Examiner*—Mark Rosenbaum
*Attorney, Agent, or Firm*—Sherman & Shalloway

[57] ABSTRACT

Disclosed is a process for the preparation of cans which comprises pressing a flexible lid comprising an aluminum foil as a substrate and a heat-sealable resin layer formed on the surface thereof to a metallic can body being formed of a surface-treated ferromagnetic steel plate and having a curl on the edge of an opening in such a positional relation that the curl portion of the can body confronts the resin layer of the lid, and induction-heating the curl portion selectively by a high-frequency induction-heating coil located in the vicinity of the periphery of the curl portion to form a seal between the curl portion and the lid by heat-sealing. According to this process, the curl portion to be heat-sealed is selectively heated, and heat-sealing can be accomplished in a short time while preventing deterioration of a lacquer or sealant. A copolymer of ethylene with a carbonyl group-containing ethylenic monomer, especially an ethylene-vinyl acetate copolymer, which has the surface subjected to the corona discharge treatment, is used as the sealant. A canned provision is prepared by heat-sealing a sealing lid to the curl portion of a can body in the above-mentioned manner, packing a content into the lidded can body and double-seaming another lid to the flange portion of the can body.

8 Claims, 11 Drawing Figures

PROCESS FOR PREPARATION OF CANS AND CANNED PROVISIONS

BACKGROUND OF THE INVENTION

1. Field of the Invention

The present invention relates to a process for preparing a can in which a seal is formed between a curl portion on the edge of the mouth of a can body and a flexible lid by heat-sealing, and also to a process for preparing a canned provision by using the so prepared can.

2. Description of the Prior Art

A sealing lid comprising a flexible substrate such as an aluminum foil and a layer of a hot-melt adhesive formed thereon is widely used for a bottle for packing a moisture-absorbing food or the like therein as an inner lid guaranteeing the integrity of the content (complete seal of the content) and providing an easily openable seal. However, industrial trials to use this sealing lid as an inner lid for a can for packing toasted layer or the like therein have proved unsuccessful. More specifically, in order to bond a sealing lid closely to the mouth of a can body, it is necessary to heat a hot-melt adhesive layer at a temperature higher than the softening point or melting point thereof, but since the thermal conductivity of the material of the can is much higher than the material of an ordinary bottle, the heat applied to the portion to be heat-sealed is conducted to other portions and it is very difficult to elevate the temperature of the portion to be heat-sealed to a level exceeding the softening or melting point of the hot-melt adhesive in a short time. Of course, the sealing portion of the lid can be heat-sealed to the can body by intensely heating the can body or the sealing portion of the lid for a long time. In this case, however, a lacquer or printing ink layer formed on the can body or the lid is scorched or discolored to degrade the appearance characteristics or the adhesive layer is thermally decomposed to cause deterioration of the adhesion and sealing characteristics.

These defects may be moderated to some extent if a hot-melt adhesive having a relatively low melting point, for example, an adhesive comprising an ethylene-vinyl acetate copolymer having a low melting point, a wax and a tackifying resin, is employed. However, the use of this hot-melt adhesive having a low melting point still involves problems. For example, the sealing layer of this low-melting-point hot-melt adhesive is brittle and it is readily peeled in fine pieces at the time of handing the sealing lid or opening the lid, and there is caused a so-called dusting phenomenon in which these fine pieces fall in the content or adhere to the content. Therefore, the use of this hot-melt adhesive is not preferred from the sanitary viewpoint. Moreover, a hot-melt adhesive composition of this type ordinarily has a peculiar smell and the flavor of the content is readily degraded. This is another defect.

BRIEF SUMMARY OF THE INVENTION

The present inventors have conducted investigations with a view to develop a process for heat-sealing a sealing lid to the mouth of a can body in a short time while eliminating the foregoing defects, and found that if a surface-treated ferromagnetic steel plate is chosen as a can material and if a sealing lid is piled on a curl portion formed on the mouth of a can body of this material and the assembly is subjected to high-frequency induction heating, the magnetic flux density is increased in the curl portion by virtue of the ferromagnetic characteristic of the curl portion and this curl portion can be selectively heated, with the result that the above-mentioned defects can be completely eliminated. The present invention is based on this finding.

It is therefore a primary object of the present invention to provide a process for preparing a can, especially an easy-open can, in which the mouth portion of a metallic can body can be heat-sealed in a short time by using a flexible sealing lid.

Another object of the present invention is to provide a process for forming a sealing structure between the mouth of a metallic can body and a flexible sealing lid by strong and secure heat-sealing while preventing degradation or discoloration of a lacquer or printing ink layer or thermal deterioration of the adhesive layer.

Still another object of the present invention is to provide a novel process for forming a seal in the mouth portion of a metallic can body by heat-sealing the mouth portion with the use of a lid having a non-wax type adhesive layer excellent in the resistance to dusting, the heat-sealability, the sealing characteristics and the flavor-retaining property.

In accordance with the present invention, there is provided a process for the preparation of cans which comprises the steps of (i) pressing a flexible lid comprising an aluminum foil as a substrate and a heat-sealable resin layer formed on the surface thereof to a metallic can body being formed of a surface-treated ferromagnetic steel plate and having a curl on the edge of an opening in such a positional relation that the curl portion of the can body confronts the resin layer of the lid, and (ii) induction-heating the curl portion selectively by a high-frequency induction-heating coil located in the vicinity of the periphery of the curl portion, said steps being carried out simultaneously, or sequentially in an order of the step (i) to the step (ii) or in a reverse order, whereby a seal is formed between the curl portion and the lid by heat-sealing.

As pointed out hereinbefore, the most characteristic feature of the present invention resides in the combination of formation of a curl portion composed of a surface-treated ferromagnetic steel plate in the mouth of a metallic can body with high-frequency induction heating of the press-bonded assembly of this curl portion and a heat-sealable lid.

A metallic can formed of a surface-treated steel plate is known, and also high-frequency induction-heating is known as means for heating metals. In the present invention, if a curl portion is formed in the mouth, to be heat-sealed, of a metallic can body formed of a surface-treated steel plate and this curl portion and the above-mentioned sealing lid are subjected to high-frequency induction-heating in the closely pressed state, excellent effects that cannot be expected from these two known facts can be attained.

More specifically, if a heat-sealing lid is piled on the mouth of a can body and heating is carried out while pressing a heat sealer on the heat-sealing lid, the heat is transferred from the aluminum foil substrate to the can body by conduction and an extremely long time is necessary for heat-sealing, resulting in occurrence of troubles such as degradation and deterioration of the lacquer or printing ink layer and the adhesive layer.

In contrast, according to the present invention, since the curl portion of the mouth of the can body is composed of a surface-treated ferromagnetic steel plate, if the press-bonded assembly of the curl portion and the sealing lid is subjected to induction-heating, the line of the magnetic force is highly absorbed in the curl portion because of the ferromagnetic characteristic of the curl portion and the density of the magnetic flux is therefore increased in the curl portion. Furthermore, the electric resistance of the surface-treated steel plate is higher than the electric resistance of the aluminum foil. Accordingly, the curl portion of the mouth of the can body is selectively and preferentially heated, and therefore, heat-sealing is accomplished in a short time effectively while preventing the above-mentioned deterioration of the lacquer layer and the like.

As is apparent from the foregoing illustration, in the conventional process for heat-sealing a bottle or can, an aluminum foil substrate having a small heat capacity is first heated and the mouth portion of the bottle or can is then heated by conduction of the heat, whereas in the process of the present invention, the curl portion of a can having a large heat capacity is selectively and preferentially heated. Accordingly, both the processes are quite different from each other in the sequence of heating.

In the present invention, the curl portion formed in the mouth of the can body exerts multiple effects in attaining the object of forming a strong and secure sealing structure in a short time by heat-sealing. More specifically, this curl portion exerts not only a function of making it possible to form a sealing in a relatively broad area or along a relatively long width between this curl portion and the sealing lid but also very advantageous functions of increasing the surface area to be heat-sealed at the step of high-frequency induction-heating, that is, the surface area of the ferromagnetic material present in the magnetic field, thereby to increase the quantity of the generated heat, and giving a heat capacity sufficient to soften or melt the adhesive to the portion to be heat-sealed.

The present invention will now be described in detail with reference to the accompanying drawings.

DETAILED DESCRIPTION OF THE PREFERRED EMBODIMENTS

Figure 1:
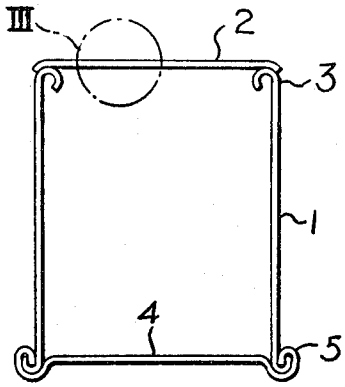
FIG. 1 is a sectional side view showing one example of the heat-sealed can prepared according to the present invention.

Referring to FIG. 1 showing an example of the can prepared according to the present invention, this can comprises a can body 1 formed of a surface-treated ferromagnetic steel plate and a sealing lid 2 applied to the edge of one opening of the can body 1. An inwardly bent curl portion 3 is formed on the edge of this opening. This curl portion 3 and sealing lid 2 are heat-sealed through a layer of a heat-sealable resin described hereinafter. An ordinary can lid 4 is fixed to the edge of the other opening of the can body 1 by a double seam 5.

Figure 2:
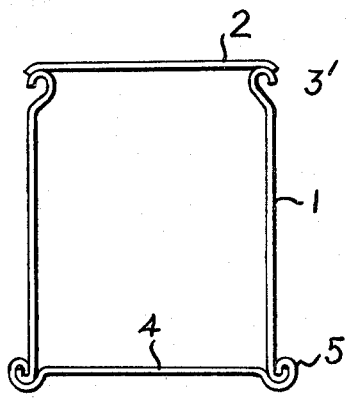
FIG. 2 is a sectional side view showing another example of the heat-sealed can prepared according to the present invention.

An outwardly bent curl portion 3' as shown in FIG. 2 may be formed instead of the inwardly bent curl portion 3.

In the present invention, it is important that the can body should be formed of a surface-treated ferromagnetic steel plate. The term "surface treatment" used herein is a generic term for the surface finishing treatment for preventing corrosion of metals, maintaining a good appearance and hardening the surface, as defined in Iwanami's Dictionary of Physics and Chemistry published on May 10, 1978. More specifically, the surface treatment includes electrolytic plating such as chromium plating or tin plating, melt plating such as non-electrolytic plating, zinc plating or tin melt plating, chemical or electrolytic treatment in chromic acid and/or phosphoric acid, flame spraying, vacuum evaporation deposition, sputtering, lining and coating.

As the surface-treated steel plate that is preferably used in the present invention, there can be mentioned, for example, a tinplate, a steel plate electrolytically treated with chromic acid (tin-free steel plate), and a steel plate laminated with a resin film (such as a film of a thermoplastic polyester).

The kind and shape of the can are not particularly critical in the present invention. For example, a can having no side seam, such as a drawn can or a draw-ironed can, and a so-called seam can having a side seam formed by welding, soldering or bonding with an adhesive can be used in the present invention.

Figure 3:
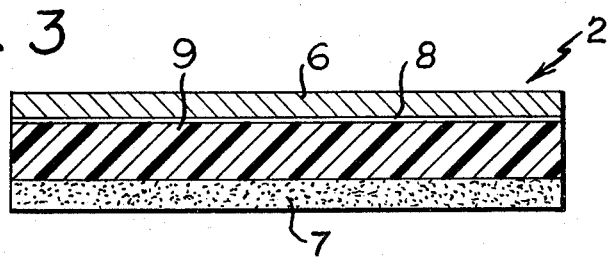
FIG. 3 is an enlarged sectional view of a sealing lid that is used in the present invention.

Referring to FIG. 3 which is an enlarged view showing the section of the sealing lid 2, this sealing lid comprises an aluminum foil 6 and a heat-sealable resin layer 7 formed on one surface of the aluminum foil 6. In the embodiment shown in FIG. 3, an intermediate resin layer 9, described hereinafter, is formed through a known anchoring agent layer 8 between the heat-sealable resin layer 7 and the aluminum foil substrate 6. Of course, these intermediate resin layer 7 and anchoring agent layer 8 may be omitted.

All of the known heat-sealants may be used for the heat-sealable resin layer. In order to provide a sealing lid excellent in the dusting resistance, the heat-sealability, the sealing characteristic and the flavor-retaining property, it is preferred that a non-wax type heat-sealable resin be used.

In accordance with one preferred embodiment of the present invention, a copolymer of ethylene with a carbonyl group-containing ethylenic monomer, which has the outer surface subjected to the corona discharge treatment, is used for the resin layer 7. If this copolymer having the outer surface subjected to the corona discharge treatment is used as the sealant and heat-sealing is performed between this sealant and the surface-treated steel plate, the heat-seal strength is prominently improved and this improvement is attained without incorporation of a wax which is not preferred from the viewpoints of the dusting resistance and the strength of the sealant per se. Moreover, if the sealant having the surface subjected to the corona discharge treatment is used, it becomes possible to use a copolymer having a lower vinyl acetate content than in the conventional hot-melt adhesive including a wax, and the flavor-retaining property and dusting resistance can be remarkably improved.

As the carbonyl group-containing ethylenic monomer, there can be mentioned ethylenically unsaturated monomers containing a carbonyl group $$-\underset{\underset{O}{\|}}{C}-,$$

which is derived from a carboxylic acid, a carboxylic anhydride, a carboxylic acid ester, a carboxylic acid amide or imide, an aldehyde or a ketone. A copolymer of ethylene with such unsaturated monomer is used.

Preferred carbonyl group-containing ethylenically unsaturated monomers are described below, though monomers that can be used in the present invention are not limited to these monomers.

A. Ethylenically unsaturated carboxylic acids:

Acrylic acid, methacrylic acid, maleic acid, fumaric acid, crotonic acid, itaconic acid, citraconic acid and 5-norbornene-2,3-dicarboxylic acid.

B. Ethylenically unsaturated carboxylic anhydrides:

Maleic anhydride, citraconic anhydride, 5-norbornene-2,3-dicarboxylic anhydride and tetrahydrophthalic anhydride.

C. Ethylenically unsaturated esters:

Ethyl acrylate, methyl methacrylate, 2-ethylhexyl acrylate, monoethyl maleate, diethyl maleate, vinyl acetate, vinyl propionate, propyl $\gamma$-hydroxymethacrylate, ethyl $\beta$-hydroxyacrylate, glycidyl acrylate and glycidyl methacrylate.

D. Ethylenically unsaturated amides and imides:

Acrylamide, methacrylamide and maleimide.

E. Ethylenically unsaturated aldehydes and ketones:

Acrolein, methacrolein, vinylmethyl ketone and vinylbutyl ketone.

Such carbonyl group-containing ethylenically unsaturated monomer may be contained in the copolymer in an amount of 0.5 to 40% by weight, particularly 3 to 25% by weight. When the unsaturated monomer content is lower than the above lower limit, even if the corona discharge treatment is carried out, a sufficient heat-seal strength cannot be obtained, and when the unsaturated monomer content is higher than the above higher limit, the shapeability or flavor-retaining property is reduced. This carbonyl group-containing ethylenically unsaturated monomer may be included in the main or side chain of the polymer in the form of a so-called random, block or graft copolymer. These copolymers may be prepared by known means.

As the copolymer that is easily available and suitable for attaining the objects of the present invention, there can be mentioned, in order of importance, an ethylene-vinyl acetate copolymer, an ionomer (ethylenic ionized copolymer) and an ethylene-acrylic acid copolymer.

The molecular weight of the copolymer of ethylene with a carbonyl group-containing ethylenic monomer is not particularly critical, so far as it is a film-forming molecular weight. From the viewpoints of the mechanical characteristics and processability, it is preferred to use a copolymer having a melt index (MI) of 0.1 to 60 g/10 minutes.

As the substrate 6, not only an aluminum foil but also a laminate of an aluminum foil and paper, an aluminum foil having one surface coated with a paint or resin and an aluminum foil on which a biaxially stretched film of a polyester or the like is laminated may preferably used.

The copolymer of ethylene with a carbonyl group-containing ethylenic monomer, which is formed in a film in advance, may be laminated on the flexible substrate, or this copolymer may be laminated by extrusion coating on the flexible substrate. In the former case, a laminate may be formed by so-called dry lamination using an isocyanate type adhesive. In the latter case, an organic titanate type or isocyanate type anchoring agent is coated on the surface of the substrate to which the copolymer is to be applied, and the copolymer is extrusion-coated on this surface. Furthermore, the heat-sealing substrate may be prepared by a so-called sandwich lamination method in which an anchoring agent such as mentioned above to the surface of the flexible substrate 6 and low density polyethylene or a copolymer of ethylene with an ethylenic monomer is extruded as an intermediate layer between the surface of the substrate 6 and a film 7 of the above-mentioned copolymer.

The corona discharge treatment of the copolymer of ethylene with a carbonyl group-containing ethylenic monomer may be conducted on a film of the copolymer before lamination on the substrate, or the corona discharge treatment may be performed after lamination. The corona discharge treatment is a known film surface-treating technique, and this treatment can be carried out by a known method.

A knife edge electrode, a wire electrode, a rotary insulated electrode and other known corona discharge electrode may be used as the discharge electrode. Ordinarily, the treatment is carried out while controlling the gap between the film to be treated and the electrode end to 0.5 to 2.0 mm.

A generator of the spark gap type, the vacuum tube type or high frequency impulse type may be used as the generator of a corona discharge treatment machine. When the corona discharge treatment is carried out at an applied voltage of 5 to 25 KV and an output of 1 to 500 watt.minute/$m^2$, especially 3 to 100 watt.minute/$m^2$, good results can be obtained.

When a film of the copolymer of ethylene with a carbonyl group-containing ethylenic monomer is subjected to the corona discharge treatment, both the surfaces may be treated. In this case, even if an anchoring agent or adhesive is not especially used, the copolymer layer can be heat-bonded to the flexible substrate. This is another advantage attained by the present invention.

In accordance with another embodiment of the present invention, a blend of an ethylene-vinyl acetate copolymer with a vinyl aromatic hydrocarbon polymer or a terpene type polymer is used as the heat-sealant layer 7.

From the viewpoints of the heat-sealability and the flavor-retaining property, it is important that in the ethylene-vinyl acetate copolymer in this blend, the content of vinyl acetate should be 3 to 30% by weight, especially 5 to 25% by weight. If the vinyl acetate content is lower than the above lower limit, the heat-sealability is insufficient, and if the vinyl acetate content is higher than the above-mentioned higher limit, the flavor-retaining property is insufficient.

It is preferred that the melt index of the ethylene-vinyl acetate copolymer be in the range of 2 to 60 g/10 minutes. If the melt index is outside this range, lamination processing such as extrusion coating becomes difficult, and if the melt index is lower than 2 g/10 minutes, the heat-sealability tends to be reduced.

As the vinyl aromatic hydrocarbon polymer, there can be mentioned, for example, homopolymers and copolymers of monomers represented by the following general formula (1) and copolymers of these monomers with other ethylenically unsaturated monomers:

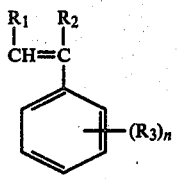

(1)

wherein $R_1$ and $R_2$ stand for a hydrogen atom or an alkyl group having up to 4 carbon atoms (hereinafter referred to as "lower alkyl group"), $R_3$ stands for an alkyl group having up to 4 carbon atoms, and n is an integer of from 0 to 2.

As such vinyl aromatic hydrocarbon polymer, there can be mentioned polystyrene, poly-α-methylstyrene, polyvinyltoluene, poly-β-methylstyrene, polyisopropenyltoluene, an α-methylstyrene/vinyltoluene copolymer, a styrene/ethyl acrylate copolymer, a styrene/ethyl acrylate/methyl methacrylate copolymer and a styrene/butadiene copolymer.

As the terpene type polymer, there can be mentioned homopolymers and copolymers of dipentene, α-pinene, β-pinene and isoprene. These terpene type polymers may be modified with phenol or an organic acid.

In such vinyl aromatic hydrocarbon polymer or terpene type polymer, it is preferred that the molecular weight be relatively low and it is especially preferred that the softening point determined by the ring and ball method be in the range of 40° to 130° C.

In the present embodiment, it is important that the ethylene-vinyl acetate copolymer and the vinyl aromatic hydrocarbon polymer or terpene type copolymer should be used at a weight ratio of from 95/5 to 70/30, especially from 93/7 to 80/20. If the amount of the ethylene-vinyl acetate copolymer is larger than the above upper limit, the heat-sealability is reduced, and if the amount of the ethylene-vinyl acetate copolymer is smaller than the above lower limit, the dusting resistance is reduced and the film-shapeability of adhesive layer is degraded.

Known additives may be incorporated in this blend according to known recipes, so far as the heat-sealability is not degraded. For example, a lubricant such as a fatty acid amide or an anti-blocking agent such as silica may be incorporated so as to improve the blocking resistance.

In the present embodiment, in order to prevent peeling of the respective laminated layers and improve the easy-openability, it is preferred that an intermediate layer 9 composed of low density polyethylene or an ethylene-vinyl acetate copolymer be formed. Polyethylene having a density of 0.915 to 0.94 and a melt index (MI) of 2 to 60 g/10 minutes is preferably used as the low density polyethylene for the intermediate layer. An ethylene-vinyl acetate copolymer having a vinyl acetate content of up to 10% by weight, especially 1 to 6% by weight, may be used instead of the low density polyethylene. It is preferred that the melt index of this copolymer be in the range described above with respect to the low density polyethylene. The resin used for this intermediate layer is relatively soft and elastic, and it gives an appropriate cushioning property and a good shock-absorbing property to the sealing lid. When a sealing lid having the above-mentioned layer structure is employed, even if fine convexities or concavities or fine scars or scratches are present in the mouth portion of a vessel, a secure seal can be provided along the entire circumference of the vessel by heat-sealing. Furthermore, unexpected breakage of the seal by a shock or a change of the temperature can be conveniently prevented.

Of course, in the present invention, a known hot-melt adhesive comprising a low-melting-point ethylene-vinyl acetate copolymer and/or low density polyethylene as a base material and a wax and a tackifying resin can be used. Also in this case, the advantage of the present invention that heat-sealing can be accomplished at a high speed with use of one layer can be similarly attained.

Figure 4:
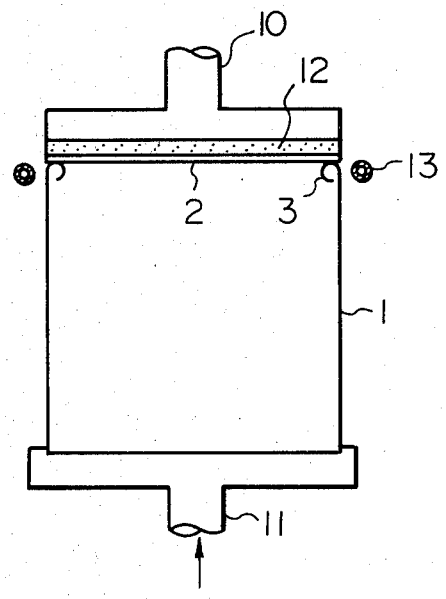
FIG. 4 is a diagram illustrating one embodiment of the heat-sealing step in the process of the present invention.
Figure 5:
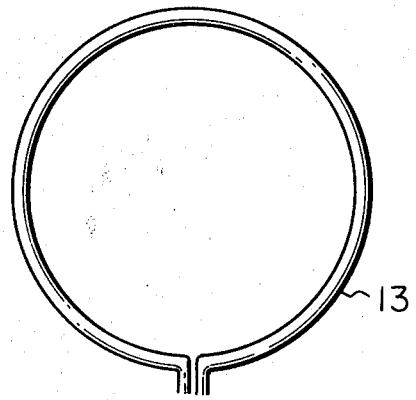
FIG. 5 is a plan view showing a high-frequency induction-heating coil used at the heat-sealing step shown in FIG. 4.

Referring to FIG. 4 illustrating the preparation steps of the process of the present invention, the flexible sealing lid 2 is piled on the metallic can body 1 in such a positional relation that the curl portion 3 confronts the resin layer of the lid 2, and they are pressed by a pair of upper and lower pressing members 10 and 11. A packing composed of an elastic material 12 such as a silicone rubber may be interposed between the upper pressing member 10 and the sealing lid 2. A high-frequency induction-heating coil 13 formed of, for example, a copper pipe is arranged in the vicinity of the periphery of the curl portion 3 of the can body 1, and when a high-frequency electric current is caused to flow in this coil 13, the curl portion 3 is induction-heated by the generated magnetic flux, whereby a seal is formed between the lid 2 and the curl portion 3 by heat-sealing. As shown in a plan view of FIG. 5, a high-frequency induction-heating coil having a circular shape may be used. The assembly of the can body and the lid may be induction-heated while keeping it in the stationary state, but if the assembly is induction-heated while rotating the assembly, the entire periphery of the mouth of the can body can be heat-sealed more uniformly.

Figure 6:
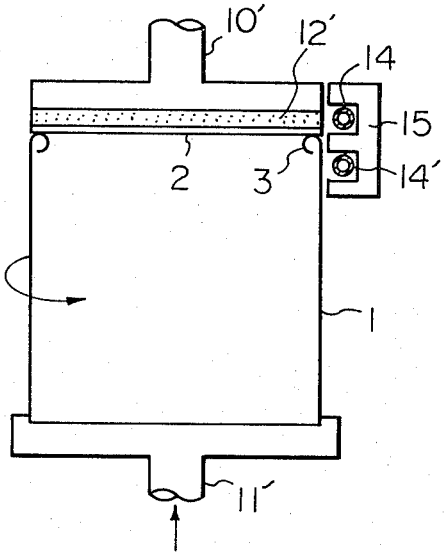
FIG. 6 is a diagram illustrating another embodiment of the heat-sealing step in the process of the present invention.
Figure 7:
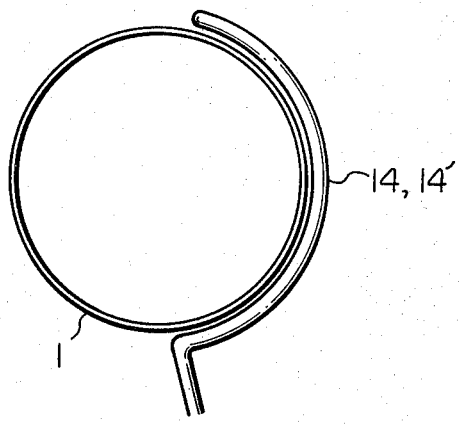
FIG. 7 is a plan view showing a high-frequency induction-heating coil used at the heat-sealing step shown in FIG. 6.

A high-frequency induction-heating coil having a different shape as shown in FIG. 6 may be used. The high-frequency induction-heating coil shown in FIG. 6 comprises a pair of copper pipes 14 and 14' arranged in the vicinity of the curl portion 3 of the can body. High-frequency electric current flowing in opposite directions are supplied to these copper pipes. A ferrite core 15 is used to intensify the magnetic flux generated in the heating coil. When this heating coil is employed, the magnetic flux generated in the heating coil is restricted in the vicinity of the curl portion of the can body, and therefore, the curl portion composed of a ferromagnetic metal can be highly selectively heated over the aluminum foil of the sealing lid. Heating coils having a semicircular shape as shown in a plan view of FIG. 7 are ordinarily used as the heating coils 14 and 14'. In order to effect heating uniformly, the can is rotated during the induction-heating step, and heat-sealing is completed by carrying out induction-heating in this manner. Of course, the shape of the induction-heating coil is not limited to the semi-circular shape, and for example, an induction-heating coil comprising a plurality of split segments may be used.

Furthermore, induction-heating can be performed according to a method in which a circular high-frequency induction-heating coil located above the curl portion of the can body is used and the can is kept in the stationary state during the induction-heating step, though this method is not specifically illustrated in the drawings.

In case of a three-piece can as shown in FIGS. 1 and 2, there may be adopted a method in which the can lid 4 is double-seamed to the can body 1, the content is packed in the can body 1 and the sealing lid 2 is heat-sealed to the can body 1. However, various advantages can be attained by reversing this order, that is, by adopting a method in which the sealing lid 2 is first heat-sealed to the can body 1, the content is then packed in the can body 1 and the lid 4 is finally double-seamed to the can body 1.

In accordance with another embodiment of the present invention, there is provided a process for the preparation of canned provisions, which comprises the steps of pressing a flexible lid comprising an aluminum foil as a substrate and a heat-sealable resin layer formed on the surface thereof to a metallic can body being formed of a surface-treated ferromagnetic steel plate and having a curl on the edge of one opening and a flange portion on the other opening in such a positional relation that the curl portion of the can body confronts the resin layer of the flexible lid, induction-heating the curl portion selectively by a high-frequency induction-heating coil located in the vicinity of the periphery of the curl portion, said pressing and induction-heating steps being carried out simultaneously or sequentially in the above-mentioned order or in the reverse order, thereby to form a seal between the curl portion and the flexible lid, packing a content into the can body having the sealing lid heat-sealed thereto, and double-seaming a lid to the flange portion of the can body.

According to the conventional technique, sealing with a flexible lid member having a heat-sealable resin layer is carried out by heat-sealing after packing a content into a vessel, whether the vessel may be a glass vessel or a plastic vessel. Since the mouth portion of such vessel is a bad heat conductor, there is no fear of occurrence of a phenomenon in which the vessel or content is heated to an undesirable high level by the heat applied at the heat-sealing step. However, in case of a metallic can, since the material of the vessel is a good heat conductor, the vessel and the content are heated to an undesirable high level, resulting in deterioration of the content.

Recently, from the viewpoints of saving of resources and reduction of distribution expenses, it is desired to reduce the head space in canned provisions. However, if the head space is reduced, the content packed in the upper portion directly undergoes an influence of strong heat applied at the heat-sealing step, and drastic deterioration of the content cannot be avoided.

In contrast, in accordance with the present embodiment of the present invention, since a seal is formed between the metallic can body and the flexible sealing lid by heat-sealing prior to the packing of the content, heating of a packed food or the like is not caused at the heat-sealing step and therefore, deterioration of the packed food or the like by heating is completely prevented. Moreover, the amount of the content packed in a can body can be increased, and the objects of saving resources and reducing distribution expenses can be simultaneously attained. A gas or bad smell is produced from various materials heated at the heat-sealing step, and if the content is packed prior to heat-sealing according to the conventional technique, such gas or smell is sealed in the vessel and degrades the flavor of the content. According to the present invention, in contrast, since packing of the content and double-sealing are carried out after heat-sealing, sealing of such gas or smell into the can together with the content can be completely prevented. Furthermore, if heat-sealing is carried out after packing of the content, the content falling or scattered at the packing step ordinarily adheres to the mouth portion of the vessel, and because of the presence of this different material, heat-sealing becomes insufficient or the heat-seal strength is reduced. However, according to the present invention, this disadvantage can be effectively eliminated, and a secure seal having a high reliability can be formed, as will be apparent from the foregoing illustration.

Figure 8:
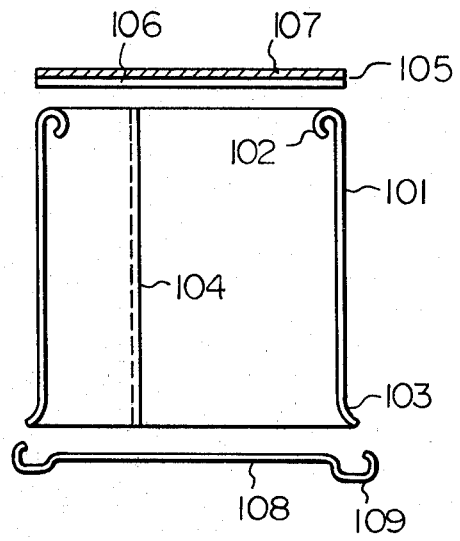
FIG. 8 is a sectional side view illustrating constituent members of a can in the fragmentary state.

Referring to FIG. 8 illustrating a can prepared according to the present invention, a can body 101 has a curl portion 102 on the edge of one opening and a flange portion 103 on the edge of the other opening. This can body 101 is ordinarily formed by molding a metal plate into a cylinder and bonding the lapped ends of the metal plate to form a seam 104.

A flexible sealing lid 105 to be bonded to the curl portion 102 of the can body 101 has a heat-sealable resin layer 106 on the surface thereof. This resin layer 106 is formed on an aluminum foil 107.

A lid 108 to be double-seamed to the flange portion 103 of the can body 101 has an annular groove 109 to be engaged with the flange portion 103, which is formed in the peripheral portion of the lid 108.

Figure 9:
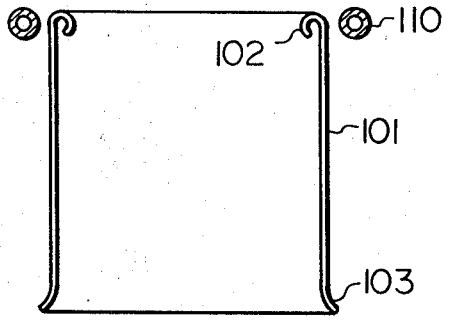
FIG. 9 is a diagram illustrating the step of heating a can body.
Figure 10:
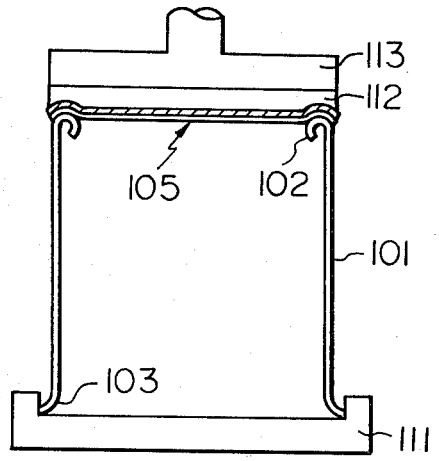
FIG. 10 is a diagram illustrating the step of pressing and heat-sealing a sealing lid to a can body.
Figure 11:
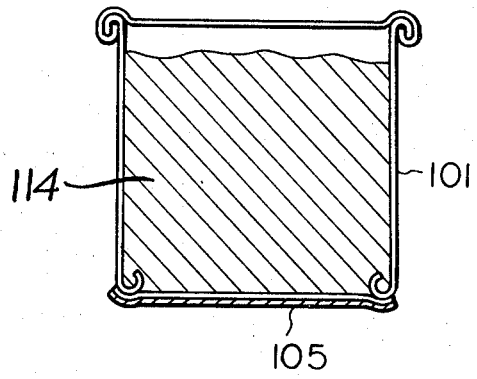
FIG. 11 is a diagram illustrating the step of double-seaming a can lid to a can body.

Referring to FIGS. 9 to 11 illustrating the preparation steps of the present invention, the curl portion 102 of the can body 101 is heated in advance at a temperature higher than the softening point of the resin 106 of the sealing lid 105. Referring to FIG. 9, this heating is accomplished by using a high-frequency induction-heating coil 110, as described hereinbefore, which is arranged in the vicinity of the periphery of the curl portion 102 of the can body 101, in the same manner as described hereinbefore.

Then, the sealing lid 105 is piled on the can body 101 having the curl portion 103 thus heated, so that the curl portion 102 confronts the resins layer 106 of the sealing lid 105, and a seal is formed by heat-sealing. As shown in FIG. 10, the can body 101 is supported at the flange portion 103 by a positioning member 111, and the sealing lid 105 positioned and placed on the curl portion 102 is downwardly pressed by a pressing member 113 through an elastic member 112 composed of a rubber or the like. In this state, a seal is formed between the can body 101 and the sealing lid 105 by heat-sealing.

Referring to FIG. 11, the sealing lid 105 of the can body 101 is located below, and a content 114 is packed in the can body 101. Then, the lid 108 is double-seamed through the annular groove 109 to the flange portion 103 of the can body 101. Thus, a canned provision is obtained.

The present invention will now be described in detail with reference to the following Examples that by no means limit the scope of the invention.

EXAMPLE 1

A biaxially stretched, printed polyethylene terephthalate film having a thickness of 38μ was laminated on an aluminum foil having a thickness of 20μ by using an isocyanate type adhesive. An isocyanate type anchoring agent was coated and dried on the aluminum foil surface of the laminate. Low density polyethylene having a melt index of 4.4 g/10 minutes as determined according to the method of ASTM D-1238, a density of 0.922 g/cm$^3$ as determined according to the method of ASTM D-1504 and a melting point of 109° C. was melt-extruded and coated on the anchoring agent-coated surface through a T-die having a width of 650 mm at a resin temperature of 310° C. in a die portion by using an extruder including a screw having a diameter of 65 mm. Then, a blend comprising 90% by weight of an ethylene-vinyl acetate copolymer having a vinyl acetate content of 20% by weight, a melt index of 18 g/10 minutes, a density of 0.941 g/cm$^3$ and a melting point of 92° C. and 10% by weight of an α-methylstyrene-vinyltoluene copolymer having a softening point of 92° C. as determined according to the ring and ball method and a density of 1.04 g/cm$^3$ was melt-extruded and coated on the coated surface of the laminate through a T-die having a width of 650 mm at a resin temperature of 240° C. in a die portion by using an extruder including a screw having a diameter of 65 mm to obtain a laminate sheet having a structure of 38μ biaxially stretched polyethylene terephthalate layer/20μ aluminum foil/20μ low density polyethylene layer/30μ ethylenevinyl acetate copolymer blend layer. Circular sealing aluminum lids having a diameter of 100 mm were punched out from the so obtained laminate sheet.

A can body having an inner diameter of 74 mm and a height of 138 mm was prepared from a can blank composed of a ferromagnetic tinplate having one surface printed and being coated with a finishing lacquer comprising a styrenated epoxy ester as a main component by using a welding can blank former. A curl portion bent inwardly was formed on the edge of one opening of the so obtained can body.

The above-mentioned sealing lid was pressed to the curl portion-formed opening of the tinplate can body and the curl portion was heated by supplying a high-frequency electric current for 1.0 second to a high-frequency induction-heating coil having a circular shape and including a ferrite core, which was located above the periphery of the curl portion-formed opening of the can body, whereby the sealing lid was heat-sealed to the curl portion of the above-mentioned opening of the can body.

Scorching or discoloration of the printing ink layer of the sealing lid or the coating or printing ink layer of the curl portion was not caused at all by the above high-frequency sealing operation.

When the sealing lid was subjected to the leakage test, it was found that the sealing effect of the sealed portion was sufficient. When the seal strength of the sealing lid was measured, it was found that the seal strength was 1250 g/1.5 cm.

Powdery cocoa was packed in twenty welded tinplate can bodies, to each of which the sealing aluminum foil lid had been heat-sealed in the same manner as described above, and a tinplate lid was double-seamed to an opening of each packed can body. The so obtained sealed cans containing powdery cocoa packed therein were stored for 50 days at normal temperatures. When the packed powdery cocoa was taken out, it was found that the powdery cocoa was kept in a good dry condition and a good flavor was retained. In each of the sealed cans, the sealing lid could be opened very smoothly without occurrence of the dusting phenomenon, and none of the sealant was left in the curl portion of the can after opening of the sealing lid.

EXAMPLES 2 TO 5

Laminate sheets Nos. 2 to 5 having a laminate structure shown in Table 1 were prepared by using materials shown in Table 1 according to the same method as described in Example 1.

Circular sealing aluminum lids were punched out from these laminate sheets Nos. 2 to 5, and they were heat-sealed to curl portions formed on openings of can bodies shown in Table 2 by carrying out induction-heating in the same manner as described in Example 1.

Troubles such as scorching and discoloration of the printing layer of the sealing lid or the coating or printing ink layer of the curl portion of the opening of the can body were not caused at all in each run.

At the leakage test, it was found that the sealing effect of the sealed portion was sufficient in each run. Results of the measurement of the seal strength made on each sealing lid are shown in Table 2.

Contents shown in Table 2 were packed in the so obtained can bodies having the sealing aluminum lid heat-sealed to one opening thereof, and after the double-seaming operation was carried out in the same manner as described in Example 1, the cans were stored for 50 days at normal temperatures. It was found that the content was kept in a good dry condition in each run. Moreover, in each run, the sealing lid could be opened very smoothly without occurrence of the dusting phenomenon, and any part of the sealant was not left in the curl portion of the can after opening of the sealing lid.

TABLE 1

| Example | Outer Layer | | Intermediate Layer | | Sealant Layer | |
|---|---|---|---|---|---|---|
| No. | Material | Thickness | Material | Thickness | Material | Thickness |
| 1 | polyethylene terephthalate/ aluminum foil | 38μ/20μ | low density polyethylene (MI = 4.05 density = 0.922 g/cc, melting point = 109° C.) | 20μ | 90 wt. % of ethylene-vinyl acetate copolymer (vinyl acetate content = 20 wt. %, MI = 20, density = 0.941 g/cc, melting point = 92° C.) and 10 wt. % of α-methylstyrene/ vinyltoluene copolymer (softening point = 92° C., density = 1.04 g/cc) | 30μ |
| 2 | aluminum foil | 40μ | low density polyethylene (MI = 4.0, density = 0.922 g/cc, | 20μ | 85 wt. % of ethylene-vinyl acetate copolymer (vinyl acetate content = 15 wt. %, | 30μ |

TABLE 1-continued

| Example No. | Outer Layer Material | Outer Layer Thickness | Intermediate Layer Material | Intermediate Layer Thickness | Sealant Layer Material | Sealant Layer Thickness |
|---|---|---|---|---|---|---|
| | | | melting point = 109° C.) | | MI = 12, density = 0.93 g/cc, melting point = 101° C.) and 15 wt. % of dipentene polymer (softening point = 115° C., acid value < 1, saponification degree < 3) | |
| 3 | aluminum foil | 40μ | ethylene-vinyl acetate copolymer (vinyl acetate content = 5 wt. %, MI = 7, density = 0.92 g/cc, melting point = 106° C.) | 30μ | 85 wt. % of ethylene-vinyl acetate copolymer (vinyl acetate content = 25 wt. %, MI = 15, density = 0.95 g/cc, melting point = 82° C.), 15 wt. % of α-methylstyrene/vinyl-toluene copolymer (softening point = 92° C., density = 1.04 g/cc and 300 ppm of oleic amide | 20μ |
| 4 | paper/low density polyethylene/ aluminum foil | 80μ/20μ/ 9μ | low density poly-ethylene (MI = 7, density = 0.919 g/cc, melting point = 108° C.) | 20μ | 90 wt. % of ethylene-vinyl acetate copolymer (vinyl acetate content = 20 wt. %, MI = 20, density = 0.941 g/cc, melting point = 92° C.) and 10 wt. % of low-molecular weight polystyrene (soft-ening point 75° C., molecular weight = 800) | 30μ |
| 5 | polyethylene terephthalate/ aluminum foil | 12μ/20μ | low density poly-ethylene (MI = 4, den-sity = 0.922 g/cc, melting point = 109° C.) | 40μ | 85 wt. % of ethylene-vinyl acetate copolymer (vinyl acetate content = 10 wt. %, MI = 15, density = 0.93 g/cc, melting point = 104° C.), 15 wt. % of α-pinene polymer (softening point = 105° C., density = 0.99 g/cc) and 800 ppm of oleic amide | 15μ |

TABLE 2

| Example No. | Can Bodies Material | Forming Method | Curl | Outer Surface Coating | Inner Sur-face Coating | Content | Seal Strength (g/1.5 cm) |
|---|---|---|---|---|---|---|---|
| 1 | tinplate | welding | inner curl | styrenated epoxy ester | not | powdery cocoa | 1250 |
| 2 | chromium-plated steel plate (tin-free steel) | welding | outer curl | epoxy ester | epoxy-urea | toasted laver | 2600 |
| 3 | polyester-laminated steel plate | draw-ironing | inner curl | not | not | nuts | 1150 |
| 4 | chromium-plated steel plated (tin-free steel) | bonding with nylon-12 | inner curl | epoxy ester | epoxy-phenol | powdery milk | 1200 |
| 5 | tinplate | soldering | inner curl | acrylamino | not | regular coffee | 1550 |

EXAMPLE 6

A laminate sheet comprising an outer layer of an aluminum foil having a thickness of 30μ, an intermediate layer having a thickness of 40μ and being composed of low density polyethylene (melt index=3.5, density=0.922 g/cm$^3$, melting point=109° C.) and a sealant layer having a thickness of 20μ and being composed of a blend comprising 90% by weight of an ethylene-vinyl acetate copolymer (vinyl acetate content=10% by weight, melt index=15, density=0.93 g/cm$^3$, melting point=104° C.), 5% by weight of low-molecular-weight polystyrene (softening point=95° C., molecular weight=1400) and 5% by weight of a $C_9$-type petroleum resin comprising vinyltoluene, α-methstyrene, β-methylstyrene and indene as main components (softening point=98° C., density=1.05 g/cm$^3$) was prepared in the same manner as described in Example 1.

Circular sealing aluminum lids were punched out from the so obtained laminate sheet.

An outwardly bent curl portion was formed on the edge of one opening of a welded tinplate can body having one surface printed and being coated with a finishing lacquer, and the above-mentioned sealing aluminum lid was pressed to the curl portion on the opening of the can body by means of a pair of pressing members. While the can body was being rotated, the curl portion of the can body was heated by supplying a high-frequency electric current for 0.5 second to a semicircular high-frequency induction-heating coil having a ferrite core and being located in the vicinity of the periphery of the curl portion of the can body. Thus, the sealing aluminum lid was heat-sealed to the curl portion of the can.

Scorching or discoloration of the printing ink layer of the sealing lid or the coating or printing ink layer of the curl portion was not caused at all by the above high-frequency sealing operation.

When the sealing lid was subjected to the leakage test, it was found that the sealing effect of the sealed portion was sufficient. When the seal strength of the sealing lid was measured, it was found that the seal strength was 1100 g/1.5 cm.

Toasted laver was packed in twenty welded tinplate can bodies, to each of which the sealing aluminum foil lid had been heat-sealed in the same manner as described above, and a tinplate lid was double-seamed to an opening of each packed can body.

The so obtained sealed can was stored at normal temperatures for 50 days and the packed toasted laver was taken out and checked. It was found that the packed toasted laver was kept in a very good dry condition and a good flavor was retained. Furthermore, the sealing lid could be opened very smoothly without occurrence of the dusting phenomenon, and after opening of the sealing lid, none of the sealant was left in the curl portion of the mouth of the can.

COMPARATIVE EXAMPLE 1

A draw-ironed can body of aluminum (DI aluminum can) was used instead of the welded tinplate can body used in Example 6, and the same sealing lid as used in Example 6 was heat-sealed under the same high-frequency induction-heating sealing conditions as adopted in Example 6. No sufficient seal strength was obtained. Accordingly, the time for supplying the high-frequency electric current was prolonged to 2.0 seconds. The seal strength was increased to 950 g/1.5 cm, but scorching of the edge of the sealing aluminum lid was caused.

COMPARATIVE EXAMPLE 2

A sealing aluminum lid was prepared in the same manner as described in Example 1 except that a blend comprising 45% by weight of an ethylene-vinyl acetate copolymer having a vinyl acetate content of 30% by weight and a melt index of 150 g/10 minutes, 45% by weight of paraffin wax having a softening point of 65° C. and 10% by weight of an $\alpha$-methylstyrene/vinyltoluene copolymer having a softening point of 92° C. and a density of 1.04 g/cm$^3$ was used instead of the blend used for the sealant layer in Example 1 and this blend was coated on the inner surface of the substrate by using a hot-melt coater. By using the so formed sealing lid, the experiments were carried out in the same manner as described in Example 1. The seal strength was satisfactory, but at the time of opening, the dusting phenomenon took place and the wax was left on the opening of the can. Furthermore, it was found that the flavor of the content was drastically degraded in the storage test.

COMPARATIVE EXAMPLE 3

A sealing aluminum lid was prepared in the same manner as described in Example 1 except that a blend comprising 55% by weight of an ethylene-vinyl acetate copolymer having a vinyl acetate content of 20% by weight, a melt index of 20 g/10 minutes, a density of 0.941 g/cm$^3$ and a melting point of 92° C. and 45% by weight of an $\alpha$-methylstyrene/vinyltoluene copolymer having a softening point of 92° C. and a density of 1.04 g/cm$^3$ was used for formation of the sealand layer. Extrusion coating was not uniformly performed, and the blocking tendency of the obtained laminate sheet was very conspicuous and this sheet was not suitable for formation of sealing lids.

EXAMPLE 7

A biaxially stretched polyethylene terephthalate film having a thickness of 38$\mu$ was laminated on an aluminum foil having a thickness of 20$\mu$ by using a isocyanate type adhesive. An ethylene-vinyl acetate copolymer having a melting point of 105° C., a density of 0.92 g/cm$^3$, a melt index of 1.5 g/10 minutes and a vinyl acetate content of 6% by weight was melt-extruded from a single-layer die by using an extruder including a screw having a diameter of 50 mm, and a film having a thickness of 40$\mu$ was formed from the extrudate according to the inflation method. At this step, one surface of the ethylene-vinyl acetate copolymer film was subjected to the corona discharge treatment under a condition of 40 watt.minute/m$^2$ by a corona discharge surface treatment apparatus having a knife edge electrode, which was disposed on a film take-up portion of a film-forming machine.

An isocyanate type anchoring agent was coated on the aluminum foil face of the laminated aluminum sheet, and low density polyethylene having a melting point of 109° C., a density of 0.922 g/cc and a melt index of 3.5 g/10 minutes was melt-extruded between the anchoring agent-coated surface of the laminated aluminum sheet and the untreated surface of the ethylene-vinyl acetate copolymer film from a T-die having a width of 650 mm at a resin temperature of 310° C. in a die portion by using an extruder including a screw having a diameter of 65 mm. The assembly was pressed by a chill roll having a diameter of 400 mm and a silicone roll having a diameter of 200 mm to obtain a laminate sheet having a structure of 38$\mu$ polyethylene terephthalate layer/20$\mu$ aluminum foil/20$\mu$ low density polyethylene layer/40$\mu$ ethylenevinyl acetate copolymer layer. Circular sealing aluminum lids having a diameter of 75 mm were punched out from the so obtained laminate sheet having the corona discharge treated surface.

An inwardly bent curl was formed on the edge of one opening of a welded tinplate can body having an inner diameter of 72 mm and a height of 138 mm and including a flange portion on the other opening, a finishing lacquer of a modified epoxy ester type being coated on the outer face of said can body. The curl portion on the edge of said one opening was heated by supplying a high-frequency electric current to a circular high-frequency induction-heating coil located in the vicinity of the periphery of the curl portion. The above-mentioned sealing lid was pressed and heat-sealed to the heated curl portion of the can body.

The so obtained sealing lid was subjected to the leakage test. It was found that a sufficient sealing effect could be attained. When the seal strength of the sealing lid was measured, it was found that the seal strength was 1870 g/1.5 cm.

Powdery cocoa was packed in twenty cans, to each of which the sealing aluminum lid was heat-sealed in the same manner as described above. A tinplate lid was double-seamed to the other opening of each packed can to obtain a sealed can having powdery cocoa packed therein. The packed cans were stored at normal temperatures for 50 days, and the packed powdery cocoa was taken out and checked. It was found that the powdery cocoa was kept in a very good dry condition and a good flavor was retained. The sealing lid could be opened very smoothly without occurrence of the dusting phenomenon. After opening, none of the sealant was left in the curl portion of the can. Furthermore, intrusion of the powdery cocoa into the sealing portion was not observed at all.

EXAMPLE 8

An isocyanate type anchoring agent was coated and dried on one surface of an aluminum foil having a thickness of 30μ and having the other surface printed, and low density polyethylene having a melt index of 3.5 g/10 minutes (as determined according to the method of ASTM D-1228), a density of 0.922 g/cm$^3$ (as determined according to the method of ASTM D-1505-68) and a melting point of 109° C. was melt-extruded and coated on the anchoring agent-coated surface from a T-die having a width of 650 mm at a resin temperature of 300° C. in a die portion by using an extruder including a screw having a diameter of 65 mm. An ethylenevinyl acetate copolymer having a vinyl acetate content of 10% by weight, a melt index of 9 g/10 minutes, a density of 0.927 g/cm$^3$ and a melting point of 104° C. was melt-extruded and coated on the polyethylene-coated surface from a T-die having a width of 650 mm at a resin temperature of 240° C. in a die portion by using an extruder including a screw having a diameter of 65 mm to obtain a laminate sheet having a structure of 30μ aluminum foil/40μ low density polyethylene layer/20μ ethylene-vinyl acetate copolymer layer.

The surface of the ethyene-vinyl acetate copolymer layer of the so obtained laminate sheet was subjected to the corona discharge treatment under a condition of 50 watt.minute/m$^2$ by a corona discharge surface treatment apparatus having a rotary insulated electrode.

Circular sealing lids having a diameter of 75 mm were punched out from the so obtained laminate sheet having one surface subjected to the corona discharge treatment.

A can body having an inner diameter of 74 mm and a height of 138 mm was prepared from a tinplate can blank having one surface printed by using a welding can body former. An outwardly bent curl portion was formed on the edge of one opening of the can body and a flange portion was formed on the other opening of the can body.

In the same manner as described in Example 6, the curl portion of the can body was heated and the sealing aluminum lid was heat-sealed to the curl portion of the can body.

When the sealing lid was subjected to the leakage test, it was found that a satisfactory sealing effect could be attained. When the seal strength of the sealing lid was measured, it was found that the seal strength was 1730 g/1.5 cm.

Cream powder was packed in twenty welded tinplate cans, to each of which the sealing aluminum lid was heat-sealed in the same manner as described above, and a tinplate lid was double-seamed to the other opening of each packed can body to obtain a sealed can having cream powder packed therein. These sealed cans were stored at normal temperatures for 50 days. The packed cream powder was taken out and checked. It was found that in each can, the powder cream was in a good dry condition and a good flavor was retained.

EXAMPLE 9

An ethylene-vinyl acetate copolymer having a vinyl acetate content of 5% by weight, a melting point of 106° C., a density of 0.92 g/cm$^3$ and a melt index of 1.5 g/10 minutes was melt-extruded from a single layer die by using an extruder including a screw having a diameter of 50 mm and was formed into a film having a thickness of 60μ according to the inflation method.

Both the surfaces of the so formed ethylene-vinyl acetate copolymer film were subjected to the corona discharge treatment under a condition of 40 watt-.minute/m$^2$ by using a corona discharge surface treatment apparatus comprising two knife edge electrodes disposed in a film take-up portion of a film forming machine.

An aluminum foil having a thickness of 40μ and having one surface printed was laminated on one surface of the so treated ethylene-vinyl acetate copolymer film by using an isocyanate type adhesive. Circular sealing aluminum lids having a diameter of 75 mm were punched out from the so obtained laminate sheet.

A can body having an inner diameter of 74 mm and a height of 138 mm was prepared from a can body blank composed of a chromium-plated steel plate (tin-free steel) having one surface printed and the other surface coated with a finishing lacquer comprising a styrenated epoxy ester as the main component by using a welding can body forming machine. An inwardly bent curl portion was formed on the edge of one opening of the can body and a flange portion was formed on the other opening of the can body.

The above-mentioned sealing aluminum lid was heat-sealed to the curl portion of the welded tin-free steel can body in the same manner as described in Example 1.

When the sealing lid was subjected to the leakage test, it was found that a satisfactory sealing effect could be obtained. When the seal strength of the sealing lid was measured, it was found that the seal strength was 1420 g/1.5 cm.

Powdery cocoa was packed into twenty can bodies, to each of which the sealing lid was heat-sealed in the same manner as described above, and a tin-free steel lid was double-seamed to the other opening of each can body to obtain a sealed can having powdery cocoa packed therein. The sealed cans were stored at normal temperatures for 50 days, and the packed powdery cocoa was taken out and checked. It was found that in each can, the powdery cocoa was kept in a good dry condition and a good flavor was retained. In each can, the sealing lid could be opened very smoothly without occurrence of the dusting phenomenon, and any part of the sealant was not left in the curl portion of the can at all. Furthermore, intrusion of the powdery cocoa into the sealing portion was not observed at all.

EXAMPLES 10 TO 14

Laminate sheets having a structure shown in Table 3 were prepared by using materials shown in Table 3 according to the same extrusion coating method as described in Example 8. The surface of the ethylene-vinyl acetate copolymer layer of each laminate sheet was subjected to the corona discharge treatment by using a corona discharge surface treatment apparatus comprising a rotary insulated electrode.

Circular sealing aluminum lids were punched out from the so obtained laminate sheets having the surface subjected to the corona discharge treatment, and they were heat-sealed to curl portions formed on one openings of can bodies shown in Table 4 by high-frequency induction-heating. When these sealing lids were subjected to the leakage test, it was found that a satisfactory sealing effect could be obtained in each run. Results of the measurement of the seal strength made on the respective sealing lids are shown in Table 4.

Contents shown in Table 4 were packed in these can bodies, each having the sealing lid heat-sealed to one opening, and after the double-seaming operation, the cans were stored at normal temperatures for 50 days. It was found that in each run, the content was kept in a good dry condition and a good flavor was retained. Furthermore, in each run, the sealing lid could be opened very smoothly without occurrence of the dusting phenomenon, and none of the sealant was left in the curl portion of the can at all.

TABLE 3

| Example No. | Outer Layer Material | Outer Layer Thickness | Intermediate Layer Material | Intermediate Layer Thickness | Sealing Layer Material | Sealing Layer Thickness |
|---|---|---|---|---|---|---|
| 10 | aluminum foil | 30μ | Low density polyethylene (MI = 4.0, density = 0.922 g/cc, melting point = 109° C.) | 30μ | ethylene-vinyl acetate copolymer (vinyl acetate content = 20 wt. %, MI = 20, density = 0.91 g/cc, melting point = 92° C.) | 20μ |
| 11 | paper/low density polyethylene/aluminum foil | 80μ/20μ/9μ | low density polyethylene (MI = 4.0, density = 0.922 g/cc, melting point = 109° C.) | 20μ | ethylene-vinyl acetate copolymer (vinyl acetate content = 15 wt. %, MI = 12, density = 0.93 g/cc, melting point = 92° C.) | 30μ |
| 12 | aluminum foil | 40μ | ethylene-vinyl acetate copolymer (vinyl acetate content = 5 wt. %, MI = 7, density = 0.92 g/cc, melting point = 106° C.) | 30μ | ethylene-vinyl acetate copolymer (vinyl acetate content = 5 wt. %, MI = 7, density = 0.92 g/cc, melting point = 106° C.) | 20μ |
| 13 | aluminum foil (free of anchoring agent) | 40μ | — | | partial Na salt of ethylene-methacrylic acid copolymer (carbonyl group concentration = 210 meq per 100 g of polymer, MI = 7, melting point = 99° C.) | 40μ |
| 14 | polyethylene terephthalate/aluminum foil (free of anchoring agent) | 12μ/20μ | — | | ethylene-acrylic acid copolymer (acrylic acid content = 8 wt. %, MI = 9, density = 0.932 g/cc, softening point = 82° C.) | 40μ |

TABLE 4

| Example No. | Can Bodies Material | Forming Method | Curl | Outer Face Coating | Inner Face Coating | Content | Seal Strength (g/1.5 cm) |
|---|---|---|---|---|---|---|---|
| 10 | tinplate | welding | outer curl | styrenated epoxy ester | not | powdery cocoa | 1540 |
| 11 | chromium-plated steel plate (tin-free steel) | welding | outer curl | epoxy ester | epoxy-urea | toasted laver | 1200 |
| 12 | polyester-laminated steel plate | draw-ironing | outer curl | not | not | nuts | 1800 |
| 13 | chromium-plated steel plate (tin-free steel) | bonding with nylon-12 | inner curl | epoxy ester | epoxy-phenol | powdery milk | 1050 |
| 14 | tinplate | soldering | outer curl | acrylamino | not | regular coffee | 1430 |

COMPARATIVE EXAMPLE 4

A sealing aluminum lid was prepared in the same manner as described in Example 7 except that a laminate sheet in which the surface of the ethylene-vinyl acetate copolymer layer was not subjected to the corona discharge treatment was used. When heat-sealing was tried by using this sealing lid in the same manner as in Example 7, the sealing lid could not be used at all because it had no heat-sealability to the curl portion formed on the opening of the can body coated with the finishing lacquer of the modified epoxy ester type.

COMPARATIVE EXAMPLE 5

A sealing aluminum lid was prepared in the same manner as described in Example 8 except that the same low density polyethylene as used for the intermediate layer was used instead of the ethylene-vinyl acetate copolymer. Even if the corona discharge treatment was carried out, the sealing lid had no heat-sealability to the curl portion formed on the opening of the can body coated with the finishing lacquer of the modified epoxy ester type. Accordingly, this sealing lid could not be practically used at all.

COMPARATIVE EXAMPLE 6

A sealing aluminum lid was prepared in the same manner as described in Example 9 except that a laminate sheet in which the surface of the ethylene-vinyl acetate copolymer layer was not subjected to the corona discharge treatment was used. This sealing lid had no heat-sealability to the curl portion formed on the opening of the can body.

EXAMPLE 15

A biaxially stretched polyethylene terephthalate film having a thickness of 12μ was laminated on an aluminum foil having a thickness of 20μ by using a isocyanate type adhesive, and high density polyethylene was laminated in a thickness of 70μ on the surface of the aluminum foil of this laminate by using a isocyanate type adhesive.

By using the so formed laminated having a three-layer structure and the same corona discharge-treated ethylenevinyl acetate copolymer film having a thickness of 40μ, as used in Example 7, a laminate sheet having a structure of 12μ polyethylene terephthalate layer/20μ aluminum foil/70μ high density polyethylene layer/20μ low density polyethylene layer/40μ ethylene-vinyl acetate copolymer layer was prepared according to the same extrusion lamination method as described in Example 7.

Sealed cans were prepared by using the so formed laminate sheet in the same manner as described in Example 7.

The so obtained sealed cans were characterized in that the plane evenness of the sealing lid was very excellent.

What we claim is:

1. A method of heat-sealing a heat-sealable lid to an open end of a can body which comprises providing a metallic can body formed of a surface-treated ferromagnetic steel plate, the edge of said open end being formed into a curled portion, feeding a flexible lid comprising an aluminum foil as a substrate and a heat-sealable resin layer formed on the surface of said substrate onto the edge of the opening of the can body in such a positional relation that the curled portion of the can body confronts the resin layer of the lid, pressing the lid to the curl portion of the can body, and induction-heating the curl portion selectively by a high-frequency induction heating coil located in the vicinity of the periphery of the curled portion to form a seal between the curled portion and the lid.

2. A process for the preparation of canned provisions which comprises providing a metallic can body formed of a surface-treated ferromagnetic steel plate, one open end of said can body being formed into a curled portion and the other open end being formed into a flange, feeding a flexible lid comprising an aluminum foil as a substrate and a heat-sealable resin layer formed on the surface of said substrate onto the curled portion of the can body in such a positional relation that the curled portion of the can body confronts the resin layer of the lid, pressing the lid to the curled portion of the can body, induction-heating the curled portion selectively by a high-frequency induction heating coil located in the vicinity of the periphery of the curled portion to form a seal between the curled portion and the lid, packing a content into the can body having the sealing lid heat-sealed thereto, and double-seaming a lid to the flange portion of the can body.

3. A method of heat sealing a heat-sealable lid to an open end of a can body which comprises providing a metallic can body formed of a surface-treated ferromagnetic steel plate, the edge of said open end being formed into a curled portion, feeding a flexible lid comprising an aluminum foil as a substrate and a heat-sealable resin layer formed on the surface of said substrate onto the edge of the opening of the can body in such a positional relation that the curled portion of the can body confronts the resin layer of the lid, said resin layer being a layer of a copolymer of ethylene with a carbonyl group-containing ethylenic monomer, the outer surface of said layer having been subjected to a corona discharge treatment, pressing the lid to the curled portion of the can body, and induction-heating the curled portion selectively by a high-frequency induction heating coil located in the vicinity of the periphery of the curled portion to form a seal between the curled portion and the lid.

4. A process for the preparation of cans according to claim 3 wherein the copolymer of ethylene with the carbonyl group-containing ethylenic monomer is an ethylene copolymer containing 0.5 to 40% by weight of a carbonyl group-containing, ethylenically unsaturated monomer.

5. A process for the preparation of cans according to claim 3 wherein the copolymer of ethylene with the carbonyl-group-containing ethylenic monomer is selected from the group consisting of an ethylene-vinyl acetate copolymer, an ionomer and an ethylene-acrylic acid copolymer.

6. A method of heat sealing a heat-sealable lid to an open end of a can body which comprises providing a metallic can body formed of a surface-treated ferromagnetic steel plate, the edge of said open end being formed into a curled portion, feeding a flexible lid comprising an aluminum foil as a substrate, a heat-sealable resin layer and intermediate layer interposed between the surface of said substrate and the heat-sealable resin layer and an intermediate layer interposed between the surface of said substrate and the heat-sealable resin layer onto the edge of the opening of the can body in such a positional relation that the curled portion of the can body confronts the resin layer of the lid, said heat-sealable resin layer being composed of a blend comprising 70 to 90% by weight of an ethylene-vinyl acetate copolymer having a vinyl acetate content of 3 to 30% by weight and 5 to 30% by weight of a compound selected from the group consisting of a vinyl aromatic hydrocarbon polymer and terpene polymer, said intermediate layer comprising low density polyethylene or an ethylene-vinyl acetate copolymer, pressing the lid to the curled portion of the can body, and induction-heating the curled portion selectively by a high-frequency induction heating coil located in the vicinity of the periphery of the curled portion to form a seal between the curled portion and the lid.

7. A process for the preparation of cans according to claim 6 wherein said compound in the blend has a softening point of 40° to 130° C. as determined according to the ring and ball method.

8. A process for the preparation of cans according to claim 6 wherein an intermediate layer composed of a member of the group consisting of low density polyethylene and an ethylene-vinyl acetate copolymer having a vinyl acetate content of up to 10% by weight is formed between the aluminum foil and the heat-sealable resin layer.

* * * * *